US012656009B2

(12) United States Patent
Cao et al.

(10) Patent No.: US 12,656,009 B2
(45) Date of Patent: Jun. 16, 2026

(54) AIR CONDITIONING SYSTEM AND METHOD FOR CONTROLLING AIR CONDITIONING SYSTEM

(71) Applicant: QINGDAO HISENSE HITACHI AIR-CONDITIONING SYSTEMS CO., LTD., Qingdao (CN)

(72) Inventors: Jihong Cao, Qingdao (CN); Xiuxia Cao, Qingdao (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 458 days.

(21) Appl. No.: 18/352,817

(22) Filed: Jul. 14, 2023

(65) Prior Publication Data

US 2024/0019159 A1 Jan. 18, 2024

Related U.S. Application Data

(63) Continuation of application No. PCT/CN2021/081679, filed on Mar. 19, 2021.

(30) Foreign Application Priority Data

Jan. 19, 2021 (CN) ..... 202110069767.X

(51) Int. Cl.
*F24F 11/64* (2018.01)
*F24F 11/523* (2018.01)
(Continued)

(52) U.S. Cl.
CPC ..... *F24F 11/64* (2018.01); *F24F 11/523* (2018.01); *F24F 11/58* (2018.01); *F24F 2110/10* (2018.01)

(58) Field of Classification Search
CPC ..... F24F 11/64; F24F 11/523; F24F 11/58; F24F 11/30; F24F 2110/10
See application file for complete search history.

(56) References Cited

U.S. PATENT DOCUMENTS 4,783,175 A 11/1988 Sugimori
5,209,400 A * 5/1993 Winslow ..... F24F 11/523 236/94

(Continued)

FOREIGN PATENT DOCUMENTS

CA 2731510 A1 11/2000
CN 1473291 A 2/2004

(Continued)

OTHER PUBLICATIONS https://brainly.com/question/15779725 (Year: 2020).*

(Continued)

*Primary Examiner* — Mohammad Ali
*Assistant Examiner* — Vincent W Chang
(74) *Attorney, Agent, or Firm* — MH2 Technology Law Group LLP

(57) ABSTRACT

An air conditioning system includes an outdoor unit, an indoor unit, a wire controller, a terminal device, a first converter, and a second converter. The first converter is configured to obtain Celsius temperature data currently transmitted in the air conditioning system, convert the currently transmitted Celsius temperature data to first Fahrenheit temperature data by using a Fahrenheit-Celsius standard conversion formula, round the first Fahrenheit temperature data to obtain target Fahrenheit temperature data, and send the target Fahrenheit temperature data to at least one of the wire controller or the terminal device. The second converter is applied to the wire controller or the terminal device and is configured to convert received Fahrenheit temperature data to target Celsius temperature data. A (Continued)

method for controlling the air conditioning system is also described.

17 Claims, 3 Drawing Sheets

(51) Int. Cl.
*F24F 11/58* (2018.01)
*F24F 110/10* (2018.01)

(56) References Cited

U.S. PATENT DOCUMENTS

| | | | | |
|---|---|---|---|---|
| 8,091,795 | B1 * | 1/2012 | McLellan | G05D 23/1923 236/94 |
| 2003/0206196 | A1 | 11/2003 | Shah | |
| 2006/0237550 | A1 | 10/2006 | Yasutani et al. | |
| 2010/0070087 | A1 | 3/2010 | Shima et al. | |
| 2015/0094863 | A1 | 4/2015 | Choi et al. | |
| 2017/0017247 | A1 * | 1/2017 | Fassier | G05D 23/1905 |
| 2018/0080672 | A1 * | 3/2018 | Yamamoto | F24F 11/59 |

FOREIGN PATENT DOCUMENTS

| | | | |
|---|---|---|---|
| CN | 1854615 | A | 11/2006 |
| CN | 1888592 | A | 1/2007 |
| CN | 101542209 | A | 9/2009 |
| CN | 101975438 | A | 2/2011 |
| CN | 104515261 | A | 4/2015 |
| CN | 104949279 | A | 9/2015 |
| CN | 105202686 | A | 12/2015 |
| CN | 106383803 | A | 2/2017 |
| JP | 2006308143 | A | 11/2006 |
| JP | 2007101014 | A | 4/2007 |
| JP | 2010060169 | A | 3/2010 |
| WO | 8704788 | A1 | 8/1987 |

OTHER PUBLICATIONS

Brainly Website (Year: 2020).*
Ma et al., Conversion of Temperature Values Between Two Measurement Unit Systems, Petro-Chemical Equipment, vol. 41, No. 6, Nov. 2012, 17 pages (including English translation).
ISR and WOISA dated Sep. 18, 2021, International Application No. PCT/CN2021/081679, 19 pages (including English translation).
Author Unknown, A Quick Conversion Method for Fahrenheit Temperature and Celsius Temperature, www.cnki.net, 10 pages (including English translation).
Notification to Grant Patent Right dated Jul. 14, 2022, CN Application No. 202110069767.X, 7 pages (including English translation).
First Office Action dated Oct. 29, 2021, CN Application No. 202110069767.X, 18 pages (including English translation).

* cited by examiner

AIR CONDITIONING SYSTEM AND METHOD FOR CONTROLLING AIR CONDITIONING SYSTEM

CROSS-REFERENCE TO RELATED APPLICATIONS

This application is a continuation application of International Application No. PCT/CN2021/081679, filed on Mar. 19, 2021, which claims priority to Chinese Patent Application No. 202110069767.X, filed on Jan. 19, 2021, which are incorporated herein by reference in their entireties.

TECHNICAL FIELD

The present disclosure relates to the field of air conditioning technologies, and in particular, to an air conditioning system and a method for controlling the air conditioning system.

BACKGROUND

Fahrenheit temperature scale and Celsius temperature scale are two major international standards for measuring temperature. When air conditioning systems are used in different regions, one of the Fahrenheit temperature scale and the Celsius temperature scale is used to measure the temperature, and a local customary temperature scale is usually used.

SUMMARY

In an aspect, an air conditioning system is provided. The air conditioning system includes an outdoor unit, an indoor unit, at least one wire controller, at least one terminal device, at least one first converter, and at least one second converter. The indoor unit is coupled to the outdoor unit. The wire controller is coupled to the indoor unit and is configured to display and set a temperature of the indoor unit. The terminal device is coupled to the indoor unit and is configured to remotely control the indoor unit in response to an operation of a user. The at least one first converter is configured to obtain Celsius temperature data currently transmitted in the air conditioning system, convert the currently transmitted Celsius temperature data to first Fahrenheit temperature data by using a Fahrenheit-Celsius standard conversion formula, round the first Fahrenheit temperature data to obtain target Fahrenheit temperature data, and send the target Fahrenheit temperature data to at least one of the wire controller or the terminal device. The at least one second converter is applied to at least one of the wire controller and the terminal device, and is configured to receive Fahrenheit temperature data inputted to the at least one of the wire controller and the terminal device, convert the inputted Fahrenheit temperature data to first Celsius temperature data by using the Fahrenheit-Celsius standard conversion formula, convert a decimal part of the first Celsius temperature data to one of a first reference value, a second reference value and a third reference value according to a comparison model, and convert the first Celsius temperature data to target Celsius temperature data by calculating a sum of an integer part of the first Celsius temperature data and one of the first reference value, the second reference value, and the third reference value after conversion.

In another aspect, a method for controlling an air conditioning system is provided. The air conditioning system includes an outdoor unit, an indoor unit, a wire controller and a terminal device. The indoor unit is coupled to the outdoor unit. The wire controller is coupled to the indoor unit and is configured to display and set a temperature of the indoor unit. The terminal device is coupled to the indoor unit and is configured to remotely control the indoor unit in response to an operation of a user. The method includes: obtaining Celsius temperature data currently transmitted in the air conditioning system; converting the currently transmitted Celsius temperature data to first Fahrenheit temperature data by using a Fahrenheit-Celsius standard conversion formula; rounding the first Fahrenheit temperature data to obtain target Fahrenheit temperature data; and sending the target Fahrenheit temperature data to at least one of the wire controller or the terminal device. The method further includes: receiving Fahrenheit temperature data inputted to at least one of the wire controller or the terminal device; converting the inputted Fahrenheit temperature data to first Celsius temperature data by using the Fahrenheit-Celsius standard conversion formula; converting a decimal part of the first Celsius temperature data to one of a first reference value, a second reference value, and a third reference value according to a comparison model; and converting the first Celsius temperature data to target Celsius temperature data by calculating a sum of an integer part of the first Celsius temperature data and one of the first reference value, the second reference value, and the third reference value after conversion.

DETAILED DESCRIPTION

Figure 1:
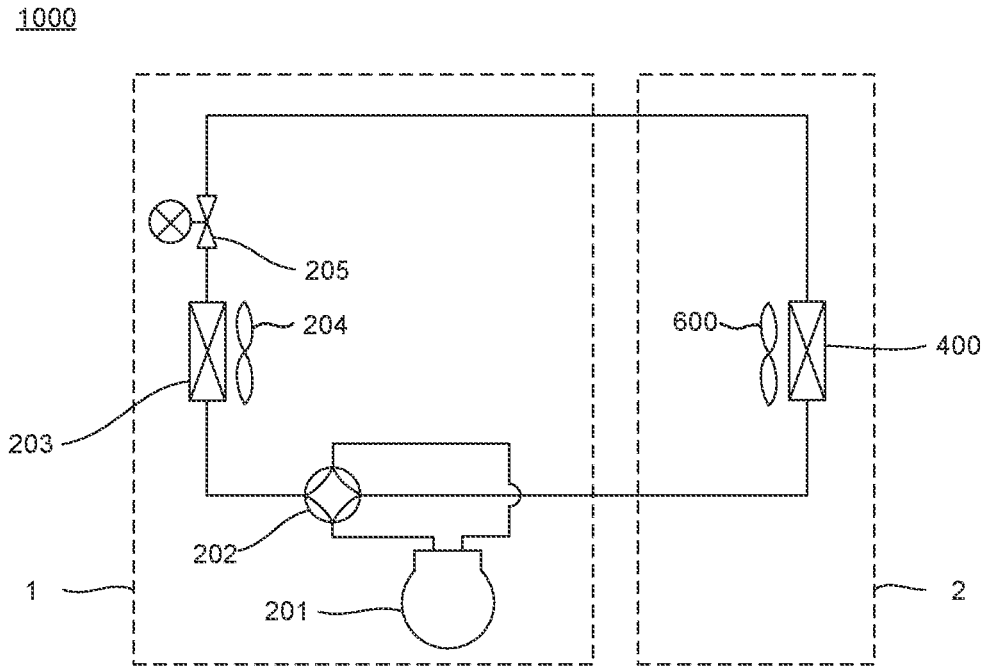
FIG. 1 is a block diagram of an air conditioning system, in accordance with some embodiments.

The technical solutions in some embodiments of the present disclosure will be described clearly and completely with reference to the accompanying drawings below. Obviously, the described embodiments are merely some but not all of embodiments of the present disclosure. All other embodiments obtained on a basis of the embodiments of the present disclosure by a person of ordinary skill in the art shall be included in the protection scope of the present disclosure.

Unless the context requires otherwise, throughout the specification and claims, the term "comprise" and other forms thereof such as the third-person singular form "comprises" and the present participle form "comprising" are construed as an open and inclusive meaning, i.e., "including, but not limited to." In the description of the specification, the terms such as "one embodiment," "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics described herein may be included in any one or more embodiments or examples in any suitable manner.

Hereinafter, the terms "first" and "second" are only used for descriptive purposes and cannot be construed as indicating or implying the relative importance or implicitly indicating the number of indicated technical features. Thus, a feature defined with "first" or "second" may explicitly or implicitly include one or more of the features. In the description of the embodiments of the present disclosure, the terms "a plurality of" and "the plurality of" each mean two or more unless otherwise specified.

In the description of some embodiments, the expressions "coupled" and "connected" and derivatives thereof may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the content herein.

The phrase "at least one of A, B, and C" has the same meaning as the phrase "at least one of A, B, or C," and they both include the following combinations of A, B, and C: only A, only B, only C, a combination of A and B, a combination of A and C, a combination of B and C, and a combination of A, B, and C.

The phrase "A and/or B" includes the following three combinations: only A, only B, and a combination of A and B.

The use of "applicable to" or "configured to" herein indicates an open and inclusive expression, which does not exclude devices that are applicable to or configured to perform additional tasks or steps.

The term "about," "substantially," or "approximately" as used herein includes a stated value and an average value within an acceptable range of deviation of a particular value. The acceptable range of deviation is determined by a person of ordinary skill in the art, considering measurement in question and errors associated with measurement of a particular quantity (i.e., limitations of a measurement system).

As used herein, the term such as "parallel," "perpendicular," or "equal" include a stated condition and a condition similar to the stated condition. The range of the similar conditions is within an acceptable range of deviation. The acceptable range of deviation is determined by a person of ordinary skill in the art in consideration of the measurement in question and the errors associated with the measurement of a specific quantity (i.e., the limitation of the measurement system). For example, the term "parallel" includes absolute parallelism and approximate parallelism, and an acceptable range of deviation of the approximate parallelism may be a deviation within 5°; the term "perpendicular" includes absolute perpendicularity and approximate perpendicularity, and an acceptable range of deviation of the approximate perpendicularity may also be a deviation within 5°; and the term "equal" includes absolute equality and approximate equality, and an acceptable range of deviation of the approximate equality may be a difference between two equals being less than or equal to 5% of either of the two equals.

Some embodiments of the present disclosure provide an air conditioning system.

As shown in FIG. 1, the air conditioning system 1000 includes an indoor unit 2 and an outdoor unit 1. The indoor unit 2 and the outdoor unit 1 are connected by a pipe to convey refrigerant. The indoor unit 2 includes an indoor heat exchanger 400 and an indoor fan 600. The outdoor unit 1 includes a compressor 201, a four-way valve 202, an outdoor heat exchanger 203, an outdoor fan 204, and an expansion valve 205. The compressor 201, the outdoor heat exchanger 203, the expansion valve 205, and the indoor heat exchanger 400 are sequentially connected to form a refrigerant loop. The refrigerant circulates in the refrigerant loop and exchanges heat with air through the outdoor heat exchanger 203 and the indoor heat exchanger 400, so as to implement a cooling mode or a heating mode of the air conditioning system 1000.

The compressor 201 is configured to compress the refrigerant, so that a low-pressure refrigerant is compressed to be a high-pressure refrigerant.

The outdoor heat exchanger 203 is configured to perform heat-exchange between outdoor air and the refrigerant conveyed in the outdoor heat exchanger 203. For example, the outdoor heat exchanger 203 operates as a condenser in the cooling mode of the air conditioning system 1000, so that the refrigerant compressed by the compressor 201 dissipates heat into the outdoor air through the outdoor heat exchanger 203 to be condensed; and the outdoor heat exchanger 203 operates as an evaporator in the heating mode of the air conditioning system 1000, so that the decompressed refrigerant absorbs heat from the outdoor air through the outdoor heat exchanger 203 to be evaporated.

In some embodiments, the outdoor heat exchanger 203 further includes heat-exchange fins, so as to expand a contact area between the outdoor air and the refrigerant conveyed in the outdoor heat exchanger 203, thereby improving heat-exchange efficiency between the outdoor air and the refrigerant.

The outdoor fan 204 is configured to suck the outdoor air into the outdoor unit 1 through an outdoor air inlet of the outdoor unit 1 and send the outdoor air, after heat-exchange between the outdoor air and the outdoor heat exchanger 203, out through an outdoor air outlet of the outdoor unit 1. The outdoor fan 204 provides power for the flow of the outdoor air.

The expansion valve 205 is connected between the outdoor heat exchanger 203 and the indoor heat exchanger 400. The pressure of the refrigerant flowing between the outdoor heat exchanger 203 and the indoor heat exchanger 400 is adjusted by an opening degree of the expansion valve 205, so as to adjust the flow of the refrigerant flowing between the outdoor heat exchanger 203 and the indoor heat exchanger 400. The flow and the pressure of the refrigerant flowing between the outdoor heat exchanger 203 and the indoor heat exchanger 400 will affect the heat-exchange performance of the outdoor heat exchanger 203 and the indoor heat exchanger 400. The expansion valve 205 may be an electronic valve. The opening degree of the expansion valve 205 is adjustable, and thus the flow and the pressure of the refrigerant flowing through the expansion valve 205 can be controlled.

The four-way valve 202 is connected in the refrigerant loop and is configured to switch a flow direction of the refrigerant in the refrigerant loop, so as to cause the air conditioning system 1000 to perform the cooling mode or the heating mode.

The indoor heat exchanger 400 is configured to perform heat-exchange between indoor air and refrigerant conveyed in the indoor heat exchanger 400. For example, the indoor heat exchanger 400 operates as an evaporator in the cooling mode of the air conditioning system 1000, so that the refrigerant, which has dissipated heat through the outdoor heat exchanger 203, absorbs heat from the indoor air through the indoor heat exchanger 400 to be evaporated. The indoor heat exchanger 400 operates as a condenser in the heating mode of the air conditioning system 1000, so that the refrigerant, which has absorbed heat through the outdoor heat exchanger 203, dissipates heat into the indoor air through the indoor heat exchanger 400 to be condensed.

In some embodiments, the indoor heat exchanger 400 further includes heat-exchange fins, so as to expand a contact area between the indoor air and the refrigerant conveyed in the indoor heat exchanger 400, thereby improving heat-exchange efficiency between the indoor air and the refrigerant.

The indoor fan 600 is configured to suck the indoor air into the indoor unit 2 through an indoor air inlet of the indoor unit 2 and send the indoor air, after heat-exchange between the indoor air and the indoor heat exchanger 400, out through an indoor air outlet of the indoor unit 2. The indoor fan 600 provides power for the flow of the indoor air.

The following will be described mainly by considering an example where the air conditioning system 1000 is a central air conditioning system, which is, however, not construed as a limitation of the present disclosure.

Figure 2:
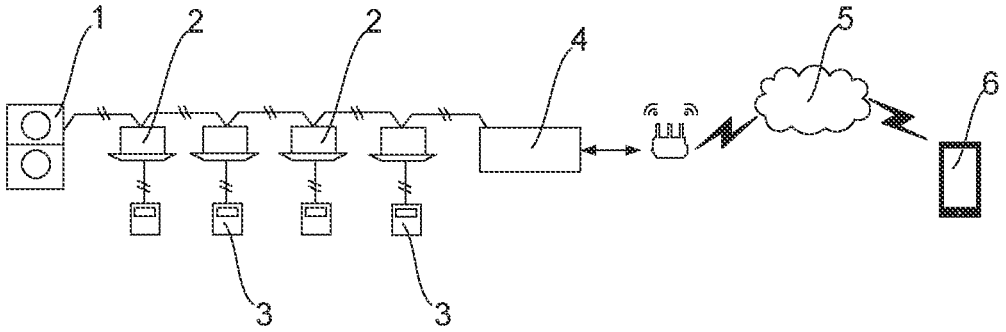
FIG. 2 is a diagram showing a system architecture of an air conditioning system, in accordance with some embodiments.

In some embodiments, the air conditioning system 1000 further includes control terminals. The control terminal is configured to display and control an operating status of the indoor unit 2, for example, display and set an air outlet temperature of the indoor unit 2. As shown in FIG. 2, the control terminals include at least one wire controller 3 (e.g., a plurality of wire controllers 3) and at least one terminal device 6 (e.g., a terminal device 6). The wire controller 3 is connected to the indoor unit 2 through a wire, so as to control the connected indoor unit 2. A single indoor unit 2 corresponds to at least one wire controller 3. The air conditioning system 1000 further includes a centralized controller 4 and a cloud server 5. The terminal device 6 is coupled to the indoor units 2 through the centralized controller 4 and the cloud server 5, so as to remotely control each indoor unit 2. The centralized controller 4 is coupled to all the indoor units 2 through an air conditioner communication bus, and the centralized controller 4 is configured to obtain operating data of each indoor unit 2 and centrally control operating status of all the indoor units 2. The cloud server 5 is interconnected with the centralized controller 4 and the terminal device 6, and the cloud server 5 is configured to provide remote data transmission, storage, and computing services for the centralized controller 4 and the terminal device 6.

For example, the centralized controller 4 sends air outlet temperature data of the indoor unit 2 to the cloud server 5, and the cloud server 5 sends the air outlet temperature data of the indoor unit 2 to the terminal device 6, so that the terminal device 6 displays the air outlet temperature data of the indoor unit 2. The user may set the air outlet temperature data of the indoor unit 2 through the terminal device 6. The terminal device 6 sends the set air outlet temperature data to the cloud server 5 after receiving the air outlet temperature data set by the user, and the cloud server 5 sends the air outlet temperature data to the centralized controller 4, so as to adjust the air outlet temperature data of the indoor unit 2 through the centralized controller 4.

It will be noted that the terminal device 6 may include a mobile terminal or a fixed terminal. The mobile terminal, for example, may include a portable computer, a personal digital assistant (PDA), a mobile phone, a tablet computer, a wireless terminal device, or the like. The fixed terminal may include a desktop computer, a television, a network server, an embedded device, or the like.

In some embodiments, the control terminal can display both Celsius temperature data and Fahrenheit temperature data. Celsius temperature and Fahrenheit temperature are two commonly used temperature representations currently. The Celsius temperature is represented by a symbol C, and a unit of the Celsius temperature is ° C. The Fahrenheit temperature is represented by a symbol F, and a unit of the Fahrenheit temperature is ° F. The Celsius temperature (C) and the Fahrenheit temperature (F) are converted by using a formula $C=(F-32)\div 1.8$. A Celsius temperature of 0° C. corresponds to a Fahrenheit temperature of 32° F. An increase of 1° C. in the Celsius temperature corresponds to an increase of 1.8° F. in the Fahrenheit temperature. For example, 1° C. corresponds to 33.8° F.

In some embodiments, the air conditioning system 1000 uses the Celsius temperature data by default for temperature display. When the user needs to use the Fahrenheit temperature data for temperature display and temperature setting, it is necessary to switch the manner of the temperature representation from the Celsius temperature data to the Fahrenheit temperature data at the control terminal (e.g., the wire controller 3). After the control terminal receives a command (e.g., a signal) to switch the temperature scale display, the air conditioning system 1000 needs to convert the Celsius temperature data to the Fahrenheit temperature data for display on all the control terminals. When the user sets the indoor temperature to a Fahrenheit temperature through the control terminal (e.g., the wire controller 3), the air conditioning system 1000 needs to convert the Fahrenheit temperature data inputted by the user to Celsius temperature data to adjust the temperature of the indoor unit 2 and transmit the converted Celsius temperature data in the air conditioning system 1000 for synchronous display on other control terminals (e.g., the terminal device 6).

Generally, in a case of setting temperature using the Fahrenheit temperature scale, the temperature data is adjusted up or down by 1° F. However, since the Celsius temperature data and the Fahrenheit temperature data have a linear but non-integer corresponding relationship, there may be a problem that two pieces of Fahrenheit temperature data correspond to a same piece of Celsius temperature data, resulting in asynchronous display between different control terminals. For example, a corresponding relationship between the Fahrenheit temperature data set by the user and a final displayed Fahrenheit temperature data is shown in Table 1.

TABLE 1

Corresponding relationship between the Fahrenheit temperature data set by the user and the final displayed Fahrenheit temperature data

| Fahrenheit temperature data (° F.) set by user | Celsius temperature data (° C., retain three decimal places) calculated according to formula | Celsius temperature data (° C.) transmitted in the air conditioning system | Fahrenheit temperature data (° F.) calculated according to formula | Fahrenheit temperature data (° F.) displayed in final |
|---|---|---|---|---|
| 60 | 15.556 | 16 | 60.8 | 61 |
| 61 | 16.111 | 16 | 60.8 | 61 |
| 62 | 16.667 | 17 | 62.6 | 63 |
| 63 | 17.222 | 17 | 62.6 | 63 |
| 64 | 17.778 | 18 | 64.4 | 64 |
| 65 | 18.333 | 18 | 64.4 | 64 |
| 66 | 18.889 | 19 | 66.2 | 66 |
| 67 | 19.444 | 19 | 66.2 | 66 |
| 68 | 20.000 | 20 | 68 | 68 |

For example, when the user sets the Fahrenheit temperature data to 65° F. through the wire controller 3, the Fahrenheit temperature data may be converted to the Celsius temperature data and transmitted in the air conditioning system 1000 to the terminal device 6. After the converted Celsius temperature data is converted to Fahrenheit temperature data on the terminal device 6, the final displayed temperature data on the terminal device 6 may be 64° F.

In order to solve the above problem, in some embodiments, a numerical mapping table between the Fahrenheit temperature data and the Celsius temperature data is established in the air conditioning system 1000. The conversion relationship between the Fahrenheit temperature data and the Celsius temperature data may be obtained by table lookup, thereby achieving synchronous display of temperature data on the wire controller 3 and the terminal device 6. For example, the mapping relationship between the Fahrenheit temperature data and the Celsius temperature data in the air conditioning system 1000 is shown in Table 2.

TABLE 2

Mapping relationship between the Fahrenheit temperature data and the Celsius temperature data in the air conditioning system 1000

| Fahrenheit temperature data (° F.) | Celsius temperature data (° C.) |
|---|---|
| 61 | 16 |
| 63 | 17 |
| 64 | 18 |
| 66 | 19 |
| 68 | 20 |

However, in the present embodiment, when the Fahrenheit temperature data is adjusted, there may be a discontinuity in the Fahrenheit temperature data. For example, when the set temperature of the air conditioning system 1000 is adjusted upwards multiple times, the set temperature is 61° F., 63° F., 64° F., 66° F., and 68° F. in sequence.

Based on the above embodiments, a data format of the Celsius temperature data in a communication protocol of the air conditioning communication bus may be further modified (e.g., a flag bit of 0 or 1 may be added to the Celsius temperature data) to establish a corresponding relationship between the Fahrenheit temperature data and Celsius temperature data with the flag bit. After obtaining the Celsius temperature data, the air conditioning system 1000 determines to display corresponding smaller Fahrenheit temperature data or corresponding larger Fahrenheit temperature data based on the flag bit, so as to achieve continuous adjustment and synchronous display of the Fahrenheit temperature data.

However, the above-mentioned embodiment is complicated. Moreover, with the expansion of control requirements, a range of the numerical mapping table needs to be continuously expanded, and an occupied storage space increases continuously, and thus the requirement for the accuracy of the numerical mapping table also increases. If the data in the numerical mapping table is wrong, it is not easy to be detected, and the numerical mapping table also has a problem of being difficult in scalability and portability.

In view of this, some embodiments of the present disclosure provide an air conditioning system 1000, and the air conditioning system 1000 includes a first converter (e.g., a Fahrenheit temperature converter) and a second converter (e.g., a Celsius temperature converter). The first converter converts the Celsius temperature data to first Fahrenheit temperature data through the Fahrenheit-Celsius standard conversion formula $C=(F-32)\div 1.8$, and then rounds the first Fahrenheit temperature data to target Fahrenheit temperature data and displays the target Fahrenheit temperature data on the wire controller 3 and the terminal device 6. The second converter converts the Fahrenheit temperature data set by the user to the Celsius temperature data through the Fahrenheit-Celsius standard conversion formula and a comparison model and transmits the Celsius temperature data in the air conditioning system 1000. In this way, the synchronous display of the temperature data on the wire controller 3 and the terminal device 6 may be implemented, an error-prone problem existing in the method of table lookup may be avoided, and the air conditioning system 1000 currently operating in the Celsius temperature data may be convenient for scalability and portability.

In some embodiments, the Celsius temperature data transmitted in the air conditioning system 1000 may be accurate to 0.5° C. The air conditioning system 1000 further includes the first converter 7, and the first converter 7 is configured to convert the Celsius temperature data transmitted in the air conditioning system 1000 to the Fahrenheit temperature data. For example, the first converter 7 is configured to obtain Celsius temperature data currently transmitted in the air conditioning system 1000, convert the currently transmitted Celsius temperature data to first Fahrenheit temperature data by using the Fahrenheit-Celsius standard conversion formula $C=(F-32)\div 1.8$, round the first Fahrenheit temperature data to target Fahrenheit temperature data, and finally display the target Fahrenheit temperature data on at least one of the wire controller 3 or the terminal device 6. The corresponding relationship between the Celsius temperature data and the Fahrenheit temperature data is shown in Table 3.

TABLE 3

Corresponding relationship between the Celsius temperature data and the Fahrenheit temperature data (partial)

| Celsius temperature data (° C.) | First Fahrenheit temperature data (° F.) | Target Fahrenheit temperature data (° F.) |
|---|---|---|
| 0.0 | 32.0 | 32 |
| 0.5 | 32.9 | 33 |
| 1.0 | 33.8 | 34 |
| 1.5 | 34.7 | 35 |

TABLE 3-continued

| Corresponding relationship between the Celsius temperature data and the Fahrenheit temperature data (partial) | | |
|---|---|---|
| Celsius temperature data (° C.) | First Fahrenheit temperature data (° F.) | Target Fahrenheit temperature data (° F.) |
| 2.0 | 35.6 | 36 |
| 2.5 | 36.5 | 37 |
| 3.0 | 37.4 | 37 |
| 3.5 | 38.3 | 38 |
| 4.0 | 39.2 | 39 |
| 4.5 | 40.1 | 40 |
| 5.0 | 41.0 | 41 |
| 5.5 | 41.9 | 42 |
| 6.0 | 42.8 | 43 |
| 6.5 | 43.7 | 44 |
| 7.0 | 44.6 | 45 |
| 7.5 | 45.5 | 46 |
| 8.0 | 46.4 | 46 |
| 8.5 | 47.3 | 47 |
| 9.0 | 48.2 | 48 |
| 9.5 | 49.1 | 49 |
| 10.0 | 50.0 | 50 |

It can be seen from the data in Table 3 that due to the high accuracy of the Celsius temperature data, the Celsius temperature data may be accurate to 0.5° C., and the Fahrenheit temperature data may be accurate to 1° F. Therefore, in a case where the Celsius temperature data is rounded to the Fahrenheit temperature data, there may be a problem that two pieces of Celsius temperature data correspond to a same piece of target Fahrenheit temperature data. That is, in a case where the Celsius temperature data obtained from the air conditioning system 1000 are different, the target Fahrenheit temperature data calculated by the first converter 7 may be the same. For example, in a case where the Celsius temperature data is 2.5° C. or 3.0° C., the corresponding displayed Fahrenheit temperature data is 37° F.: and in a case where the Celsius temperature data is 7.5° C. or 8.0° C., the corresponding displayed Fahrenheit temperature data is 46° F.

However, it can also be seen from the data in Table 3 that a piece of Celsius temperature data corresponds to a piece of Fahrenheit temperature data, and there is no case where a same piece of Celsius temperature data corresponds to two or more pieces of different Fahrenheit temperature data. Therefore, after the Celsius temperature data is obtained from the air conditioning system 1000 and converted by the first converter, the Fahrenheit temperature data displayed on the control terminals (e.g., the wire controller 3 and the terminal device 6) is consistent, thereby ensuring the synchronous display of the Fahrenheit temperature data on the control terminals.

In the air conditioning system 1000 in some embodiments of the present disclosure, the Celsius temperature data transmitted in the air conditioning system 1000 is converted to the Fahrenheit temperature data according to a same conversion manner, so that the wire controller 3 and the terminal device 6 may achieve synchronous display, thereby avoiding inconsistent display between the wire controller 3 and the terminal device 6. In addition, no matter how the user switches the temperature scales, the air conditioning system 1000 performs control in the form of Celsius temperature data. In this way, the data format of the Celsius temperature data currently transmitted in the air conditioning system 1000 may not be changed, which has a small overall effect on the air conditioning system 1000 and may achieve switching and setting of various temperature scales. Moreover, the temperature scale conversion manner does not require table lookup, thereby avoiding the problem of error-prone and lack of scalability and portability that exist in the table lookup.

In some embodiments, the air conditioning system 1000 includes a plurality of first converters 7, and the plurality of first converters 7 may be applied to the at least one wire controller 3 and the at least one terminal device 6. For example, the air conditioning system 1000 includes two first converters 7, and the two first converters 7 may be applied to a wire controller 3 and a terminal device 6, respectively.

Figure 3:
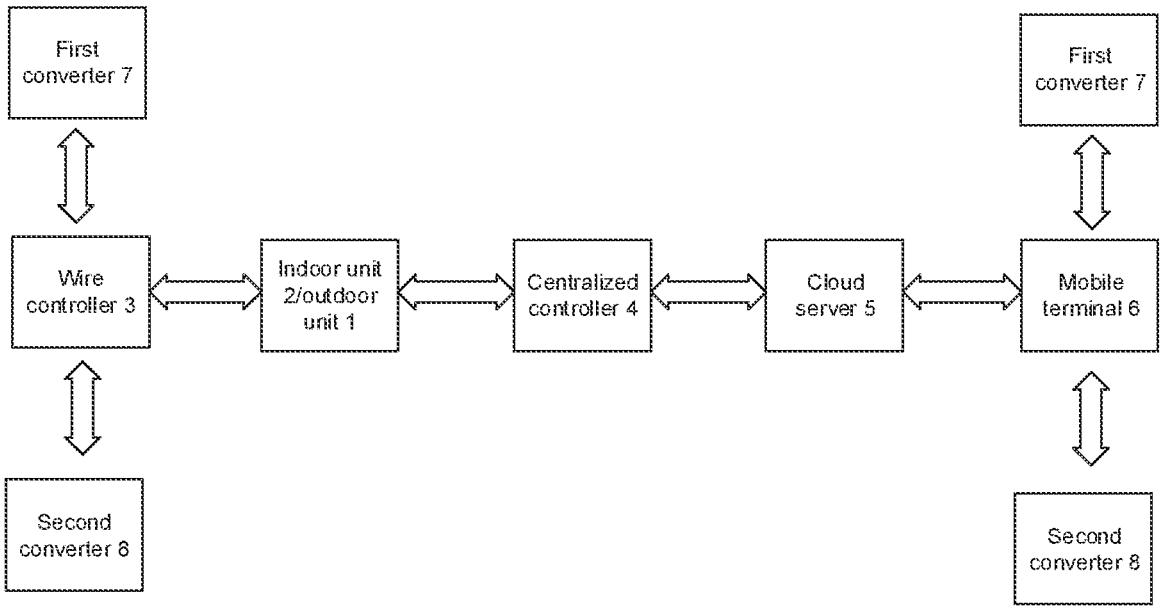
FIG. 3 is a diagram showing a system functional architecture of an air conditioning system, in accordance with some embodiments.

In this way, the first converters 7 may be individually developed in the wire controller 3 and the terminal device 6, and the air conditioning system 1000 still performs control in the form of Celsius temperature data. As shown in FIG. 3, the wire controller 3 and the terminal device 6 each obtain the Celsius temperature data currently transmitted in the air conditioning system 1000 in response to a signal for converting the Celsius temperature data to the Fahrenheit temperature data and convert the Celsius temperature data to the target Fahrenheit temperature data through the first converter and display the target Fahrenheit temperature data.

Figure 6:
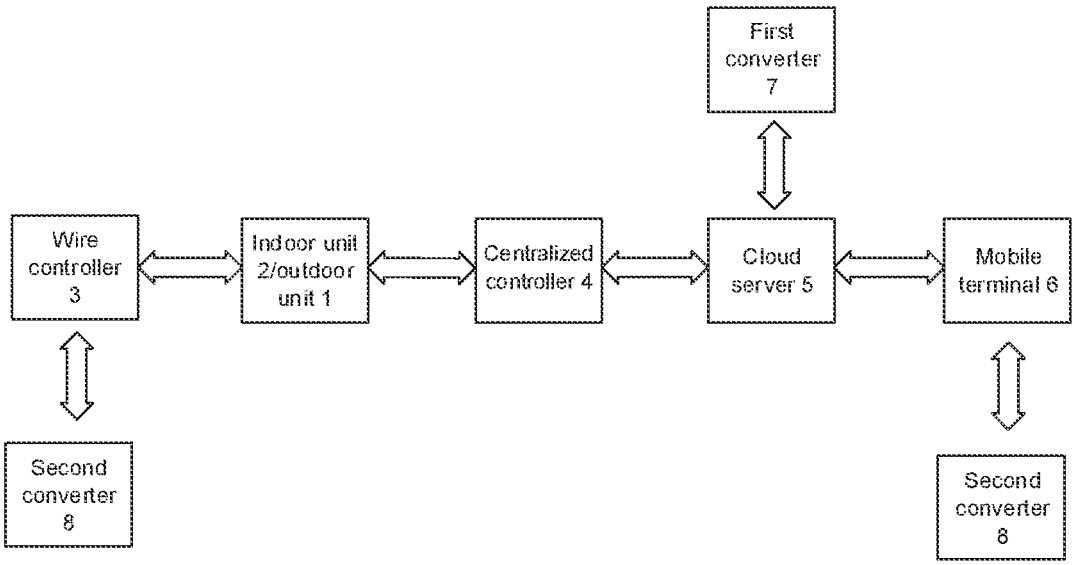
FIG. 6 is a diagram showing another system functional architecture of an air conditioning system, in accordance with some embodiments.

In some embodiments, the air conditioning system 1000 includes a single first converter 7, and the single first converter 7 may be applied to the cloud server 5. As shown in FIG. 6, a program for the first converter 7 is installed in the cloud server 5 of the air conditioning system 1000 through program upgrade or program implantation, and the air conditioning system 1000 still performs control in the form of Celsius temperature data. For example, the cloud server 5 obtains the Celsius temperature data currently transmitted in the air conditioning system 1000 in response to a signal for converting the Celsius temperature data to the Fahrenheit temperature data, converts the Celsius temperature data to the target Fahrenheit temperature data, and sends the target Fahrenheit temperature data to the centralized controller 4 and the terminal device 6. Then, the centralized controller 4 sends the target Fahrenheit temperature data to the wire controller 3 through the indoor unit 2, thereby implementing the synchronous display on the wire controller 3 and the terminal device 6.

In some embodiments, after the set temperature of the air conditioning system 1000 is converted from the Celsius temperature data to the Fahrenheit temperature data for display, the Fahrenheit temperature data further needs to be set. Therefore, referring to FIGS. 3 and 6, the air conditioning system 1000 further includes second converters 8. The second converters 8 are applied to the wire controller 3 and the terminal device 6 and are each configured to convert the Fahrenheit temperature data set by the user to the Celsius temperature data, so as to be transmitted in the air conditioning system 1000. For example, the second converter 8 is configured to receive the Fahrenheit temperature data set by the user through the wire controller 3 or the terminal device 6, convert the received Fahrenheit temperature data set by the user to first Celsius temperature data by using the Fahrenheit-Celsius standard conversion formula, and then convert a decimal part of the first Celsius temperature data according to the comparison model.

In some embodiments, the comparison model includes a first threshold H1 and a second threshold H2. For example, the first threshold H1 is less than the second threshold H2, that is, H1<H2. In a case where the decimal part of the first Celsius temperature data is less than the first threshold H1, the decimal part of the first Celsius temperature data is converted by the second converter 8 to a first reference value J1. In a case where the decimal part of the first Celsius temperature data is greater than or equal to the first threshold H1 and less than a sum (i.e., H1+H2) of the first threshold H1 and the second threshold H2, the decimal part of the first Celsius temperature data is converted by the second converter 8 to a second reference value J2. In a case where the decimal part of the first Celsius temperature data is greater than or equal to the sum (i.e., H1+H2) of the first threshold H1 and the second threshold H2, the decimal part of the first Celsius temperature data is converted by the second converter 8 to a third reference value J3. The comparison model may change the accuracy of the decimal part of the first Celsius temperature data, so that the first Celsius temperature data is converted to the target Celsius temperature data that can be transmitted in the air conditioning system 1000.

In some embodiments, in a case where the Celsius temperature data in the air conditioning system 1000 is transmitted at a minimum interval of 0.5° C., the first threshold H1 may be set to 0.3° C., the second threshold H2 may be set to 0.5° C., the first reference value J1 is equal to 0 (i.e., J1=0), the second reference value J2 is equal to 0.5 (i.e., J2=0.5), and the third reference value J3 is equal to 1 (i.e., J3=1). In this way, in a case where the decimal part of the first Celsius temperature data is less than 0.3° C., the decimal part of the first Celsius temperature data is converted to 0; in a case where the decimal part of the first Celsius temperature data is greater than or equal to 0.3° C. and less than 0.8° C. (i.e., 0.3° C.+0.5° C.), the decimal part of the first Celsius temperature data is converted to 0.5° C.; and in a case where the decimal part of the first Celsius temperature data is greater than or equal to 0.8° C. (i.e., 0.3° C.+0.5° C.), the decimal part of the first Celsius temperature data is converted to 1° C.

After converting the decimal part of the first Celsius temperature data to one of the first reference value J1, the second reference value J2, and the third reference value J3, the second converter 8 converts the first Celsius temperature data to one of target Celsius temperature data T+J1, target Celsius temperature data T+J2, or target Celsius temperature data T+J3 by calculating a sum of an integer part T of the first Celsius temperature data and one of the first reference value J1, the second reference value J2, and the third reference value J3 after conversion. The corresponding relationship between the Fahrenheit temperature data and the Celsius temperature data is shown in Table 4.

TABLE 4

Corresponding relationship between the Fahrenheit temperature data and the Celsius temperature data (partial)

| Fahrenheit temperature data (° F.) | First Celsius temperature data (° C.) | Target Celsius temperature data (° C.) |
|---|---|---|
| 32 | 0.0 | 0.0 |
| 33 | 0.6 | 0.5 |
| 34 | 1.1 | 1.0 |
| 35 | 1.7 | 1.5 |
| 36 | 2.2 | 2.0 |
| 37 | 2.8 | 3.0 |
| 38 | 3.3 | 3.5 |
| 39 | 3.9 | 4.0 |
| 40 | 4.4 | 4.5 |
| 41 | 5.0 | 5.0 |
| 42 | 5.6 | 5.5 |
| 43 | 6.1 | 6.0 |
| 44 | 6.7 | 6.5 |
| 45 | 7.2 | 7.0 |
| 46 | 7.8 | 8.0 |
| 47 | 8.3 | 8.5 |
| 48 | 8.9 | 9.0 |
| 49 | 9.4 | 9.5 |
| 50 | 10.0 | 10.0 |

It can be seen from Table 4 that in a case where the Fahrenheit temperature data is continuously adjusted up or down by 1° F., the Celsius temperature data in the air conditioning system 1000 change discontinuously, which may result in missing the target Celsius temperature data. For example, the Fahrenheit temperature data of 36° F. corresponds to the target Celsius temperature data of 2.0° C., the Fahrenheit temperature data of 37° F. corresponds to the Celsius target temperature data of 3.0° C., and the target Celsius temperature data of 2.5° C. between the target Celsius temperature data of 2.0° C. and 3.0° C. is missing. For another example, the Fahrenheit temperature data of 45° F. corresponds to the target Celsius temperature data of 7.0° C., the Fahrenheit temperature data of 46° F. corresponds to the Celsius target temperature data of 8.0° C., and the target Celsius temperature data of 7.5° C. between the target Celsius temperature data of 7.0° C. and 8.0° C. is missing. However, the missing of the target Celsius temperature data transmitted in the air conditioning system 1000 does not affect the continuous setting of the Fahrenheit temperature data by the wire controller 3 or the terminal device 6.

It can be understood that in a case where the user sets the Fahrenheit temperature data through the wire controller 3, Fahrenheit temperature data displayed by the terminal device 6 is consistent with Fahrenheit temperature data displayed by the wire controller 3. In a case where the user sets the Fahrenheit temperature data through the terminal device 6, Fahrenheit temperature data displayed by the wire controller 3 is consistent with Fahrenheit temperature data displayed by the terminal device 6. It will be noted that the above conclusions can be verified by experiments or calculations. The corresponding relationship between the Fahrenheit temperature data set by the user and the converted target Celsius temperature data, and between the converted target Celsius temperature data and the converted target Fahrenheit temperature data are shown in Table 5.

TABLE 5

Corresponding relationship between the Fahrenheit temperature data, the target Celsius temperature data, and the target Fahrenheit temperature data (partial)

| Fahrenheit temperature data (° F.) | First Celsius temperature data (° C.) | Target Celsius temperature data (° C.) | First Fahrenheit temperature data (° F.) | Target Fahrenheit temperature data (° C.) |
|---|---|---|---|---|
| 32 | 0.0 | 0.0 | 32 | 32 |
| 33 | 0.6 | 0.5 | 32.9 | 33 |
| 34 | 1.1 | 1.0 | 33.8 | 34 |
| 35 | 1.7 | 1.5 | 34.7 | 35 |
| 36 | 2.2 | 2.0 | 35.6 | 36 |
| 37 | 2.8 | 3.0 | 36.5 | 37 |
| 38 | 3.3 | 3.5 | 38.3 | 38 |
| 39 | 3.9 | 4.0 | 39.2 | 39 |
| 40 | 4.4 | 4.5 | 40.1 | 40 |
| 41 | 5.0 | 5.0 | 41 | 41 |
| 42 | 5.6 | 5.5 | 41.9 | 42 |

TABLE 5-continued

| Corresponding relationship between the Fahrenheit temperature data, the target Celsius temperature data, and the target Fahrenheit temperature data (partial) | | | | |
|---|---|---|---|---|
| Fahrenheit temperature data (° F.) | First Celsius temperature data (° C.) | Target Celsius temperature data (° C.) | First Fahrenheit temperature data (° F.) | Target Fahrenheit temperature data (° C.) |
| 43 | 6.1 | 6.0 | 42.8 | 43 |
| 44 | 6.7 | 6.5 | 43.7 | 44 |
| 45 | 7.2 | 7.0 | 44.6 | 45 |
| 46 | 7.8 | 8.0 | 45.5 | 46 |
| 47 | 8.3 | 8.5 | 47.3 | 47 |
| 48 | 8.9 | 9.0 | 48.2 | 48 |
| 49 | 9.4 | 9.5 | 49.1 | 49 |
| 50 | 10.0 | 10.0 | 50 | 50 |

Figure 4:
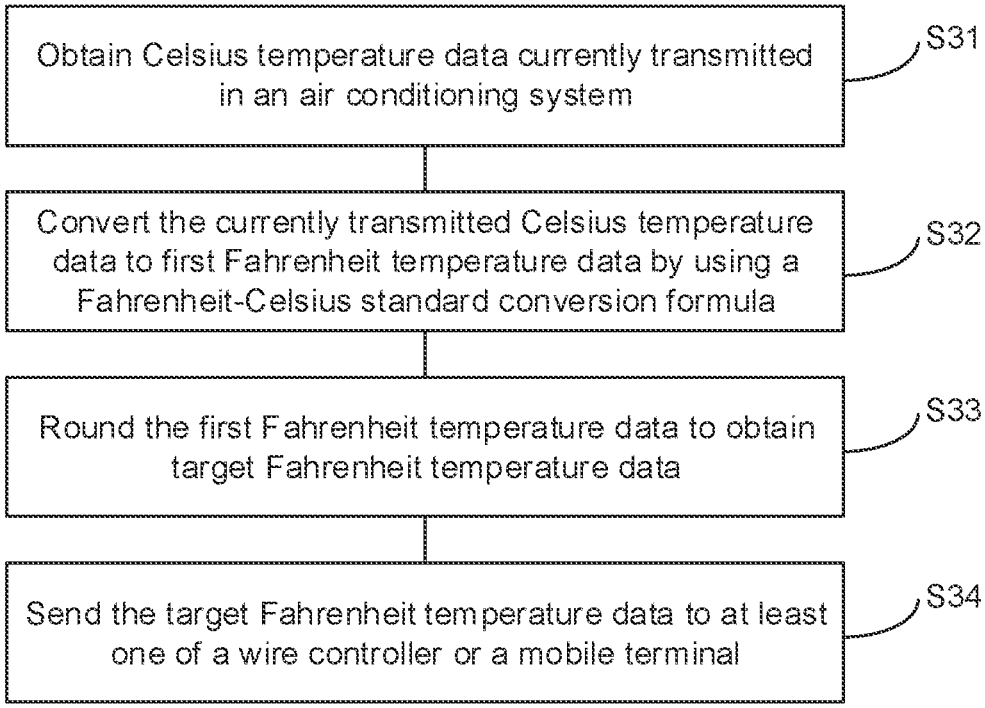
FIG. 4 is a control flow diagram of an air conditioning system, in accordance with some embodiments.

Some embodiments of the present disclosure further provide a method for controlling the air conditioning system 1000. As shown in FIG. 4, the method includes steps S31 to S34.

In step S31, Celsius temperature data currently transmitted in the air conditioning system 1000 is obtained.

In the air conditioning system 1000 in some embodiments of the present disclosure, regardless of whether the wire controller 3 and the terminal device 6 apply the Celsius temperature data or the Fahrenheit temperature data, the air conditioning system 1000 performs control in a form of Celsius temperature data.

In step S32, the currently transmitted Celsius temperature data is converted to first Fahrenheit temperature data by using a Fahrenheit-Celsius standard conversion formula.

The Fahrenheit-Celsius standard conversion formula $C=(F-32)\div 1.8$ is used to convert the Celsius temperature data to the Fahrenheit temperature data, which is recorded as the first Fahrenheit temperature data.

In step S33, the target Fahrenheit temperature data is obtained by rounding the first Fahrenheit temperature data.

As shown in Table 5, the first Fahrenheit temperature data converted by using the Fahrenheit-Celsius standard conversion formula is rounded to obtain the target Fahrenheit temperature data.

In step S34, the target Fahrenheit temperature data is sent to at least one of the wire controller 3 or the terminal device 6.

The target Fahrenheit temperature data is sent to at least one of the wire controller 3 or the terminal device 6 for application. It will be noted that the manner of applying the target Fahrenheit temperature data by the wire controller 3 and the terminal device 6 includes but is not limited to display, calculation, setting, and storage.

In some embodiments, the above-mentioned control method may be applied to the cloud server 5 through program upgrade or patch components and performed in the cloud server 5. In this case, after the air conditioning system 1000 receives a signal for converting the Celsius temperature data to the Fahrenheit temperature data, the cloud server 5 converts the Celsius temperature data obtained from the air conditioning system 1000 to the target Fahrenheit temperature data using the above-mentioned control method, and then sends the target Fahrenheit temperature data to the centralized controller 4 and the terminal device 6. The centralized controller 4 transmits the target Fahrenheit temperature data to the wire controller 3 through the indoor unit 2, so that the target Fahrenheit temperature data is applied in the wire controller 3 and the terminal device 6.

In some embodiments, the above-mentioned control method may alternatively be applied to the wire controller 3 and the terminal device 6 through program upgrade or patch components and is performed individually in the wire controller 3 and the terminal device 6. In this case, after the air conditioning system 1000 receives the signal for converting the Celsius temperature data to the Fahrenheit temperature data, the wire controller 3 converts the Celsius temperature data obtained from the air conditioning system 1000 to the target Fahrenheit temperature data using the above-mentioned control method and applies the target Fahrenheit temperature data. In addition, the terminal device 6 converts the Celsius temperature data obtained from the air conditioning system 1000 to the target Fahrenheit temperature data using the above-mentioned control method and applies the target Fahrenheit temperature data.

However, no matter whether the above-mentioned control method is applied to the cloud server 5 or applied to the wire controller 3 and the terminal device 6, the above-mentioned control method obtains the Celsius temperature data currently transmitted in the air conditioning system 1000 and converts the Celsius temperature data to the target Fahrenheit temperature data.

Figure 5:
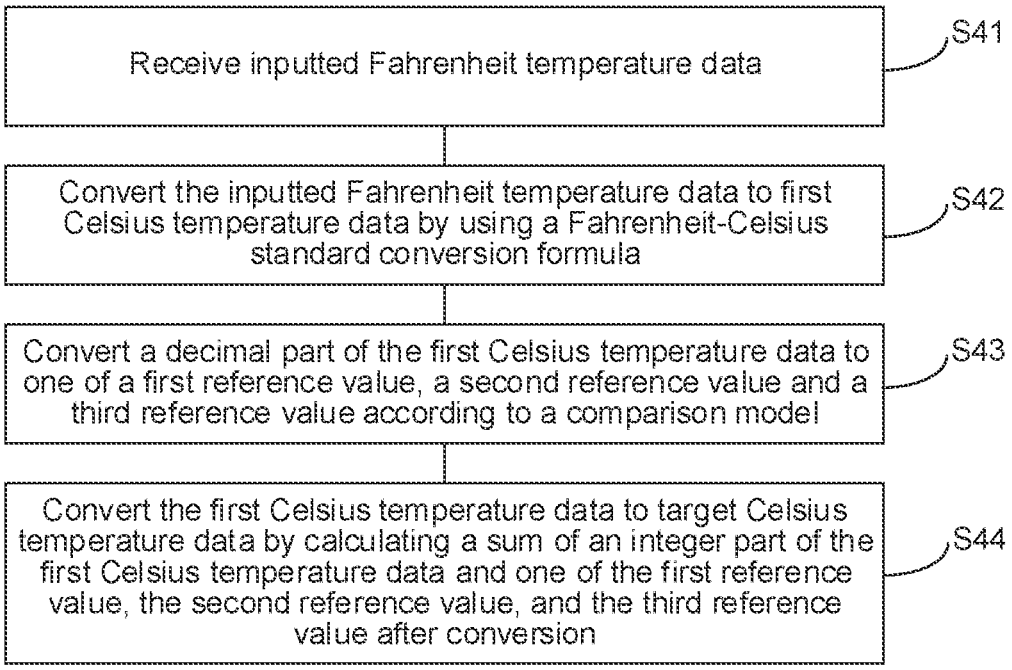
FIG. 5 is another control flow diagram of an air conditioning system, in accordance with some embodiments.

In some embodiments, as shown in FIG. 5, the method for controlling the air conditioning system 1000 further includes steps S41 to S44.

In step S41, inputted Fahrenheit temperature data is received.

The user sets and controls the air conditioning system 1000 through the wire controller 3 or the terminal device 6 by using the Fahrenheit temperature scale.

In step S42, the inputted Fahrenheit temperature data is converted to first Celsius temperature data by using the Fahrenheit-Celsius standard conversion formula.

The Fahrenheit-Celsius standard conversion formula $C=(F-32)\div 1.8$ is used to convert the Fahrenheit temperature data inputted by the user to the first Celsius temperature data.

In step S43, a decimal part of the first Celsius temperature data is converted to one of a first reference value, a second reference value, and a third reference value according to a comparison model.

The comparison model includes a first threshold H1 and a second threshold H2.

In a case where the decimal part of the first Celsius temperature data is less than the first threshold H1, the decimal part of the first Celsius temperature data is converted to a first reference value J1.

In a case where the decimal part of the first Celsius temperature data is greater than or equal to the first threshold H1 and less than a sum (i.e., H1+H2) of the first threshold H1 and the second threshold H2, the decimal part of the first Celsius temperature data is converted to a second reference value J2.

In a case where the decimal part of the first Celsius temperature data is greater than or equal to the sum (i.e., H1+H2) of the first threshold H1 and the second threshold H2, the decimal part of the first Celsius temperature data is converted to the third reference value J3.

The first threshold H1, the second threshold H2, the first reference value J1, the second reference value J2, and the third reference value J3 are set according to the actual situation of the air conditioning system 1000. For example, in a case where the wire controller 3 and the terminal device 6 set the temperature value of the air conditioning system 1000 at a regulation interval of 1° F., and the Celsius temperature data transmitted in the air conditioning system 1000 has a regulation interval of 0.5° C., the first threshold H1 is set to 0.3 (i.e., H1=0.3), the second threshold H2 is set to 0.5 (i.e., H2=0.5), the first reference value J1 is set to 0 (i.e., J1=0), the second reference value J2 is set to 0.5 (i.e., J2=0.5), and the third reference value J3 is set to 1 (i.e., J3=1).

It will be noted that, in some embodiments, the above parameters (including the first threshold H1, the second threshold H2, the first reference value J1, the second reference value J2, and the third reference value J3) are set based on actual conditions and according to experience or experimental values, which will not be repeated here.

In step S44, the first Celsius temperature data is converted to target Celsius temperature data by calculating a sum of an integer part of the first Celsius temperature data and one of the first reference value, the second reference value, and the third reference value after conversion.

That is, the target Celsius temperature data is equal to the sum of the integer part T of the first Celsius temperature data and one of the first reference value J1, the second reference value J2, and the third reference value J3.

In the air conditioning system 1000 and the method for controlling the same in some embodiments of the present disclosure, the currently transmitted Celsius temperature data is obtained from the air conditioning system 1000 through the first converter, the obtained Celsius temperature data is converted to the first Fahrenheit temperature data by using the Fahrenheit-Celsius standard conversion formula, the first Fahrenheit temperature data is rounded to obtain the target Fahrenheit temperature data, and finally the target Fahrenheit temperature data is sent to at least one of the wire controller 3 or the terminal device 6. In this way, the Celsius temperature data transmitted in the air conditioning system 1000 is converted to the Fahrenheit temperature data in the same conversion manner in both the wire controller 3 and the terminal device 6, so that the Fahrenheit temperature data is displayed synchronously on the wire controller 3 and the terminal device 6.

In addition, no matter how the user switches the temperature scales, the Celsius temperature data is transmitted in the air conditioning system 1000, and the data format of the Celsius temperature data currently transmitted in the air conditioning system 1000 may not be changed, which has a small overall effect on the air conditioning system 1000. In this way, the user requirements such as switching and setting various temperature scales may be implemented. Moreover, the temperature scale conversion manner does not require the table lookup, thereby avoiding the problem of error-prone and lack of scalability and portability that exist when ensuring the synchronous display of the Celsius temperature data and the Fahrenheit temperature data of the air conditioning system 1000 through the table lookup.

In some embodiments, when the user uses the Fahrenheit temperature to adjust the temperature of the air conditioning system 1000 through the wire controller 3 or the terminal device 6, the continuous setting of the Fahrenheit temperature data may be realized by using the comparison model. In this case, the Celsius temperature data is still transmitted and applied in the air conditioning system 1000, thereby improving adjustment accuracy of the Fahrenheit temperature data of the air conditioning system 1000.

It will be noted that, in some embodiments, the above method for controlling the air conditioning system 1000 may be implemented by a processor in a form of hardware executing computer-executed instructions in a form of software stored in a memory, which will not be repeated in detail here. Programs corresponding to the actions performed by the above air conditioning system 1000 may be stored in a software form in a non-transitory computer-readable storage medium of the air conditioning system 1000, which facilitates the processor to call and execute the operations corresponding to each component mentioned above.

The above non-transitory computer-readable storage medium may include a read-only memory (ROM), a flash memory, a hard disk, a solid-state drive (SSD), or a combination of the above types of memories.

The above processor may be a collective term for a plurality of processing elements. For example, the processor may be a central processing unit (CPU), a general-purpose processor, a digital signal processor (DSP), an application specific integrated circuit (ASIC), a field programmable gate array (FPGA) or other programmable logic devices, discrete gate or transistor logic devices, or discrete hardware components. The general-purpose processor may be a microprocessor or a specialized processor.

A person skilled in the art will understand that the scope of disclosure in the present disclosure is not limited to the above specific embodiments and may modify and substitute some elements of the embodiments without departing from the concept of the present disclosure. The scope of the present disclosure is limited by the appended claims.

What is claimed is:

1. An air conditioning system, comprising:

an outdoor unit;

an indoor unit coupled to the outdoor unit;

at least one wire controller coupled to the indoor unit; the at least one wire controller being configured to display and set a temperature of the indoor unit;

at least one terminal device coupled to the indoor unit; the at least one terminal device being configured to control the indoor unit in response to an operation of a user;

at least one first converter configured to obtain Celsius temperature data currently transmitted in the air conditioning system, convert the currently transmitted Celsius temperature data to first Fahrenheit temperature data by using a Fahrenheit-Celsius standard conversion formula, round the first Fahrenheit temperature data to obtain target Fahrenheit temperature data, and send the target Fahrenheit temperature data to at least one of the at least one wire controller or the at least one terminal device; and at least one second converter applied to at least one of the at least one wire controller and the at least one terminal device, and configured to receive Fahrenheit temperature data inputted to the at least one of the at least one wire controller and the at least one terminal device, convert the inputted Fahrenheit temperature data to first Celsius temperature data by using the Fahrenheit-Celsius standard conversion formula, convert a decimal part of the first Celsius temperature data to one of a first reference value, a second reference value, and a third reference value according to a comparison model, and convert the first Celsius temperature data to target Celsius temperature data by calculating a sum of an integer part of the first Celsius temperature data and the one of the first reference value, the second reference value, and the third reference value after conversion, wherein the comparison model includes a first threshold and a second threshold;

in a case where the decimal part of the first Celsius temperature data is less than the first threshold, the decimal part of the first Celsius temperature data being converted to the first reference value; and in a case where the decimal part of the first Celsius temperature data is greater than or equal to the first threshold and less than a sum of the first threshold and the second threshold, the decimal part of the first Celsius temperature data being converted to the second reference value;

wherein the first threshold is less than the second threshold.

2. The air conditioning system according to claim 1, wherein the comparison model further includes:

in a case where the decimal part of the first Celsius temperature data is greater than or equal to the sum of the first threshold and the second threshold, the decimal part of the first Celsius temperature data being converted to the third reference value.

3. The air conditioning system according to claim 1, wherein the first threshold is 0.3° C., and the second threshold is 0.5° C.

4. The air conditioning system according to claim 1, wherein the first reference value is 0, the second reference value is 0.5, and the third reference value is 1.

5. The air conditioning system according to claim 1, wherein the at least one first converter is applied to the at least one wire controller; and a wire controller of the at least one wire controller is configured to convert a Celsius temperature scale to a Fahrenheit temperature scale through a corresponding first converter of the at least one first converter for display in response to a received signal for converting the Celsius temperature scale to the Fahrenheit temperature scale.

6. The air conditioning system according to claim 1, wherein the at least one first converter is applied to the at least one terminal device; and a terminal device of the at least one terminal device is configured to convert a Celsius temperature scale to a Fahrenheit temperature scale through a corresponding first converter of the at least one first converter for display in response to a received signal for converting the Celsius temperature scale to the Fahrenheit temperature scale.

7. The air conditioning system according to claim 1, further comprising:

a centralized controller coupled to the indoor unit; the centralized controller being configured to centrally control an operating status of the indoor unit; and a cloud server interconnected with the centralized controller and the at least one terminal device; the cloud server being configured to provide data storage, computing, and remote transmission services for the centralized controller and the at least one terminal device.

8. The air conditioning system according to claim 7, wherein the at least one first converter includes a single first converter, and the single first converter is applied to the cloud server;

the cloud server is configured to convert a Celsius temperature scale to a Fahrenheit temperature scale through the single first converter in response to a received signal for converting the Celsius temperature scale to the Fahrenheit temperature scale and send a converted Fahrenheit temperature data to the at least one wire controller and the at least one terminal device.

9. The air conditioning system according to claim 1, wherein the at least one second converter includes a plurality of second converters, and the plurality of second converters are applied to both the at least one wire controller and the at least one terminal device.

10. A method for controlling an air conditioning system, the air conditioning system including:

an outdoor unit;

an indoor unit coupled to the outdoor unit;

a wire controller coupled to the indoor unit; the wire controller being configured to display and set a temperature of the indoor unit; and a terminal device coupled to the indoor unit; the terminal device being configured to control the indoor unit in response to an operation of a user;

the method comprising:

obtaining Celsius temperature data currently transmitted in the air conditioning system;

converting the currently transmitted Celsius temperature data to first Fahrenheit temperature data by using a Fahrenheit-Celsius standard conversion formula;

rounding the first Fahrenheit temperature data to obtain target Fahrenheit temperature data; and sending the target Fahrenheit temperature data to at least one of the wire controller or the terminal device; and the method further comprising:

receiving Fahrenheit temperature data inputted to at least one of the wire controller or the terminal device;

converting the inputted Fahrenheit temperature data to first Celsius temperature data by using the Fahrenheit-Celsius standard conversion formula;

converting a decimal part of the first Celsius temperature data to one of a first reference value, a second reference value, and a third reference value according to a comparison model; and converting the first Celsius temperature data to target Celsius temperature data by calculating a sum of an integer part of the first Celsius temperature data and the one of the first reference value, the second reference value, and the third reference value after conversion, wherein the comparison model includes a first threshold and a second threshold;

in a case where the decimal part of the first Celsius temperature data is less than the first threshold, the decimal part of the first Celsius temperature data being converted to the first reference value; and in a case where the decimal part of the first Celsius temperature data is greater than or equal to the first threshold and less than a sum of the first threshold and the second threshold, the decimal part of the first Celsius temperature data being converted to the second reference value;

wherein the first threshold is less than the second threshold.

11. The method for controlling an air conditioning system according to claim 10, wherein the comparison model further includes:

in a case where the decimal part of the first Celsius temperature data is greater than or equal to the sum of the first threshold and the second threshold, the decimal part of the first Celsius temperature data being converted to the third reference value.

12. The method for controlling an air conditioning system according to claim 10, wherein the first threshold is 0.3° C., and the second threshold is 0.5° C.

13. The method for controlling an air conditioning system according to claim 10, wherein the first reference value is 0, the second reference value is 0.5, and the third reference value is 1.

14. The method for controlling an air conditioning system according to claim 10, wherein the method is applied to the wire controller, and the method further comprising:

displaying, by the wire controller, the target Fahrenheit temperature data after the wire controller converting the currently transmitted Celsius temperature data to the target Fahrenheit temperature data.

15. The method for controlling an air conditioning system according to claim 10, wherein the method is applied to the terminal device, and the method further comprising:

displaying, by the terminal device, the target Fahrenheit temperature data after the terminal device converting the currently transmitted Celsius temperature data to the target Fahrenheit temperature data.

16. The method for controlling an air conditioning system according to claim 10, wherein the air conditioning system further includes:

a centralized controller coupled to the indoor unit; the centralized controller being configured to control an operating status of the indoor unit; and a cloud server interconnected with the centralized controller and the terminal device; the cloud server being configured to provide data storage, computing, and remote transmission services for the centralized controller and the terminal device; and the method is applied to the cloud server, and the method further comprises:

sending, by the cloud server, the target Fahrenheit temperature data to the wire controller and the terminal device.

17. An air conditioning system, comprising:

an outdoor unit;

an indoor unit coupled to the outdoor unit;

at least one wire controller coupled to the indoor unit; the at least one wire controller being configured to display and set a temperature of the indoor unit;

at least one terminal device coupled to the indoor unit; the at least one terminal device being configured to control the indoor unit in response to an operation of a user;

at least one first converter configured to obtain Celsius temperature data currently transmitted in the air conditioning system, convert the currently transmitted Celsius temperature data to first Fahrenheit temperature data by using a Fahrenheit-Celsius standard conversion formula, round the first Fahrenheit temperature data to obtain target Fahrenheit temperature data, and send the target Fahrenheit temperature data to at least one of the at least one wire controller or the at least one terminal device;

at least one second converter applied to at least one of the at least one wire controller and the at least one terminal device, and configured to receive Fahrenheit temperature data inputted to the at least one of the at least one wire controller and the at least one terminal device, convert the inputted Fahrenheit temperature data to first Celsius temperature data by using the Fahrenheit-Celsius standard conversion formula, convert a decimal part of the first Celsius temperature data to one of a first reference value, a second reference value, and a third reference value according to a comparison model, and convert the first Celsius temperature data to target Celsius temperature data by calculating a sum of an integer part of the first Celsius temperature data and the one of the first reference value, the second reference value, and the third reference value after conversion;

a centralized controller coupled to the indoor unit; the centralized controller being configured to centrally control an operating status of the indoor unit; and a cloud server interconnected with the centralized controller and the at least one terminal device; the cloud server being configured to provide data storage, computing, and remote transmission services for the centralized controller and the at least one terminal device, wherein the at least one first converter includes a single first converter, and the single first converter is applied to the cloud server; and the cloud server is configured to convert a Celsius temperature scale to a Fahrenheit temperature scale through the single first converter in response to a received signal for converting the Celsius temperature scale to the Fahrenheit temperature scale and send a converted Fahrenheit temperature data to the at least one wire controller and the at least one terminal device.

* * * * *